US008932159B2

(12) United States Patent
Lennon et al.

(10) Patent No.: US 8,932,159 B2
(45) Date of Patent: Jan. 13, 2015

(54) NON-LETHAL ARROW

(71) Applicants: Matthew Reed Lennon, Corunna, IN (US); John Jackson, Waterloo, IN (US)

(72) Inventors: Matthew Reed Lennon, Corunna, IN (US); John Jackson, Waterloo, IN (US)

(73) Assignee: Deerspace LLC, Waterloo, IN (US)

( * ) Notice: Subject to any disclaimer, the term of this patent is extended or adjusted under 35 U.S.C. 154(b) by 105 days.

(21) Appl. No.: 13/871,537

(22) Filed: Apr. 26, 2013

(65) Prior Publication Data

US 2014/0323252 A1 Oct. 30, 2014

(51) Int. Cl.
*F42B 6/08* (2006.01)

(52) U.S. Cl.
CPC ..... *F42B 6/08* (2013.01)
USPC ..... 473/578; 473/582

(58) Field of Classification Search
USPC ..... 473/578, 582, 585
See application file for complete search history.

(56) References Cited

U.S. PATENT DOCUMENTS

| | | | | |
|---|---|---|---|---|
| 1,554,653 | A | 1/1925 | Poole | |
| 2,377,498 | A | 1/1944 | Jacke | |
| 2,531,635 | A | 8/1948 | Maager | |
| 3,271,033 | A | 9/1966 | Parker | |
| 4,111,424 | A | 9/1978 | Schreiber et al. | |
| 5,033,446 | A | 7/1991 | Bradt | |
| 5,224,464 | A | 7/1993 | Burnham et al. | |
| 5,242,323 | A | 9/1993 | Rappaport | |
| 5,269,535 | A | 12/1993 | Gagne | |
| 5,836,842 | A | 11/1998 | McLearan | |
| 6,076,513 | A | 6/2000 | Doherty et al. | |
| 6,454,623 | B1 | 9/2002 | Flatau | |
| 7,601,084 | B2 | 10/2009 | Martin | |
| 7,731,612 | B2 | 6/2010 | Martin | |
| 8,012,049 | B1 | 9/2011 | Walterscheid | |
| 2006/0014598 | A1 | 1/2006 | Martin | |
| 2006/0276277 | A1 * | 12/2006 | Montefusco | 473/586 |

* cited by examiner

*Primary Examiner* — John Ricci
(74) *Attorney, Agent, or Firm* — McConnell IP Law

(57) ABSTRACT

A non-lethal arrow is disclosed that includes a shaft extending along a longitudinal axis. A nock is located on a first end of the shaft and a flight is positioned at approximately the first end of the shaft. A tip connector including a shaft connection end, wherein the shaft connection end is connected with the shaft. The shaft connection end defines a hollow interior portion sized a configured to receive an end of the shaft. A foam tip surrounds at least a portion of the tip connector. The foam tip is overmolded over the tip connector.

13 Claims, 8 Drawing Sheets

NON-LETHAL ARROW

CROSS REFERENCE TO RELATED APPLICATION

The present application is a continuation-in-part of and claims priority to U.S. patent application Ser. No. 13/311,641 entitled Non-Lethal Arrow filed on Dec. 6, 2011.

FIELD OF THE INVENTION

The present invention relates generally to an arrow and, more particularly, to a non-lethal arrow for use in recreational activities.

BACKGROUND

Many different types of arrows have been designed over the years for use in the sport of archery. While most arrows are designed to hunt animals, other arrows have been designed to mark animals for identification. Paintball has become a popular sporting event in which individuals utilize compressed gas projectile accelerators to shoot paintballs at other participants. A need exists in the arrow market for a non-lethal arrow that can be utilized in a sporting event similar to paintball.

SUMMARY

One aspect of the present invention discloses a non-lethal arrow that includes a shaft extending along a longitudinal axis. A nock is located on a first end of the shaft and a fletching, vanes or feathers is positioned at approximately the first end of the shaft. A tip connector is included that has a foam tip connection end and a shaft connection end. The shaft connection end is connected with a second end of the shaft. The foam tip connection end includes a plurality of securing ribs extending circumferentially about the foam tip connection end. The securing ribs taper upwardly toward a back surface thereby allowing the securing ribs to grip a foam tip connected with the foam tip connection end. The shaft connection end includes an elongate cylindrical portion defining a hollow tube that is sized and configured to receive the second end of the shaft. The shaft connection end includes a plurality of fins extending upwardly from the elongate cylindrical portion. The fins taper upwardly from a rear end of the elongate cylindrical portion to an outside edge of the foam tip connection end.

BRIEF DESCRIPTION OF THE DRAWINGS

The invention is further elucidated in the following on the basis of an exemplary embodiment shown in the drawings.

DETAILED DESCRIPTION

Figure 1:
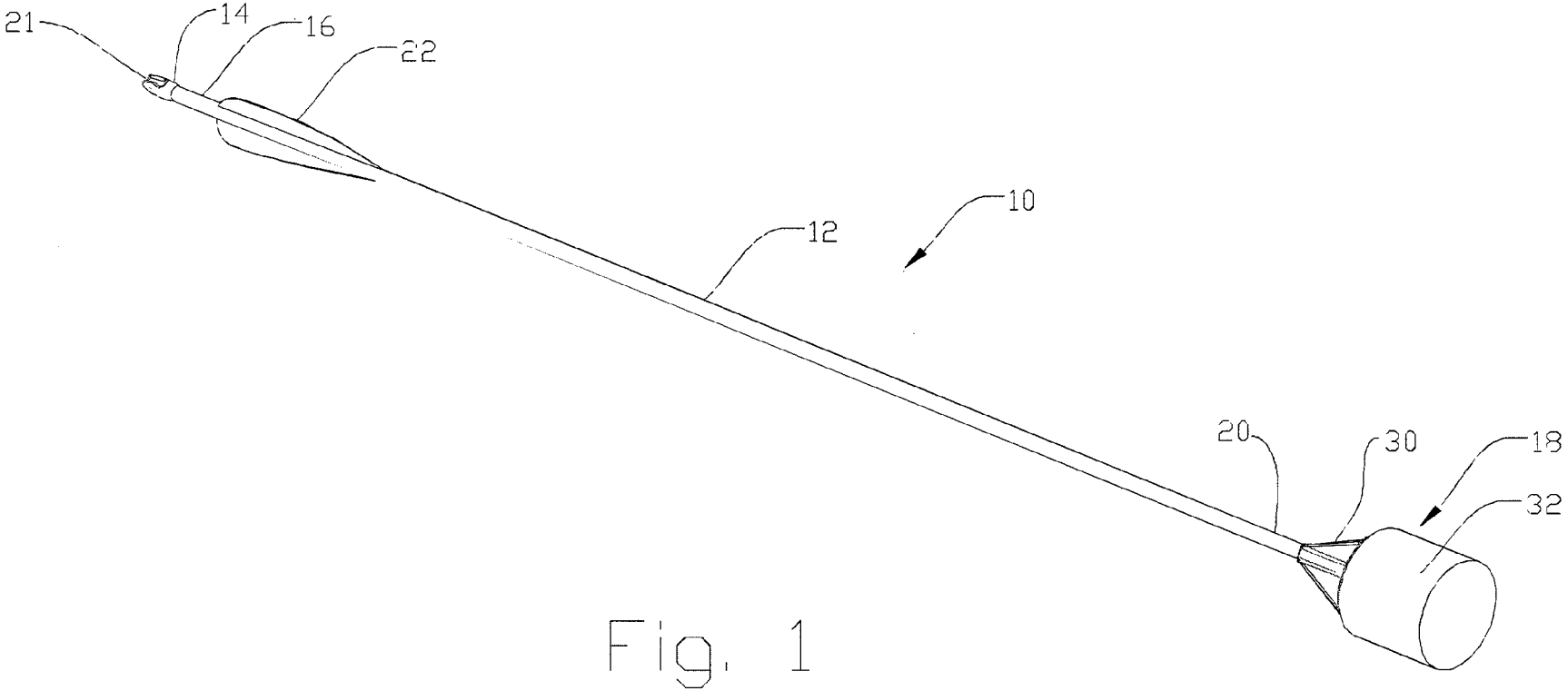
FIG. 1 illustrates a non-lethal arrow that can be utilized in a sporting event.

For the purposes of promoting an understanding of the principles of the invention, reference will now be made to the embodiment illustrated in the drawings, and specific language will be used to describe that embodiment. It will nevertheless be understood that no limitation of the scope of the invention is intended. Alterations and modifications in the illustrated device, and further applications of the principles of the invention as illustrated therein, as would normally occur to one skilled in the art to which the invention relates are contemplated, are desired to be protected. Such alternative embodiments require certain adaptations to the embodiments discussed herein that would be obvious to those skilled in the art.

Referring to FIG. 1, a non-lethal arrow 10 is illustrated that includes a shaft 12 extending along a longitudinal axis. A nock 14 is connected to a first end 16 of the shaft 12 and a non-lethal arrowhead assembly 18 is connected to a second end 20 of the shaft 12. The nock 14 includes a notch 21 that is utilized to secure a bowstring to the arrow 10. In addition, near the first end 16 of the shaft 12 is a fletching or vanes 22 that is attached or connected to the shaft 12. The fletching 22 is used to aerodynamically stabilize the arrow 10 and may be made from a plurality of materials such as synthetic polymer, feathers, or leather to name a few.

Figure 6:
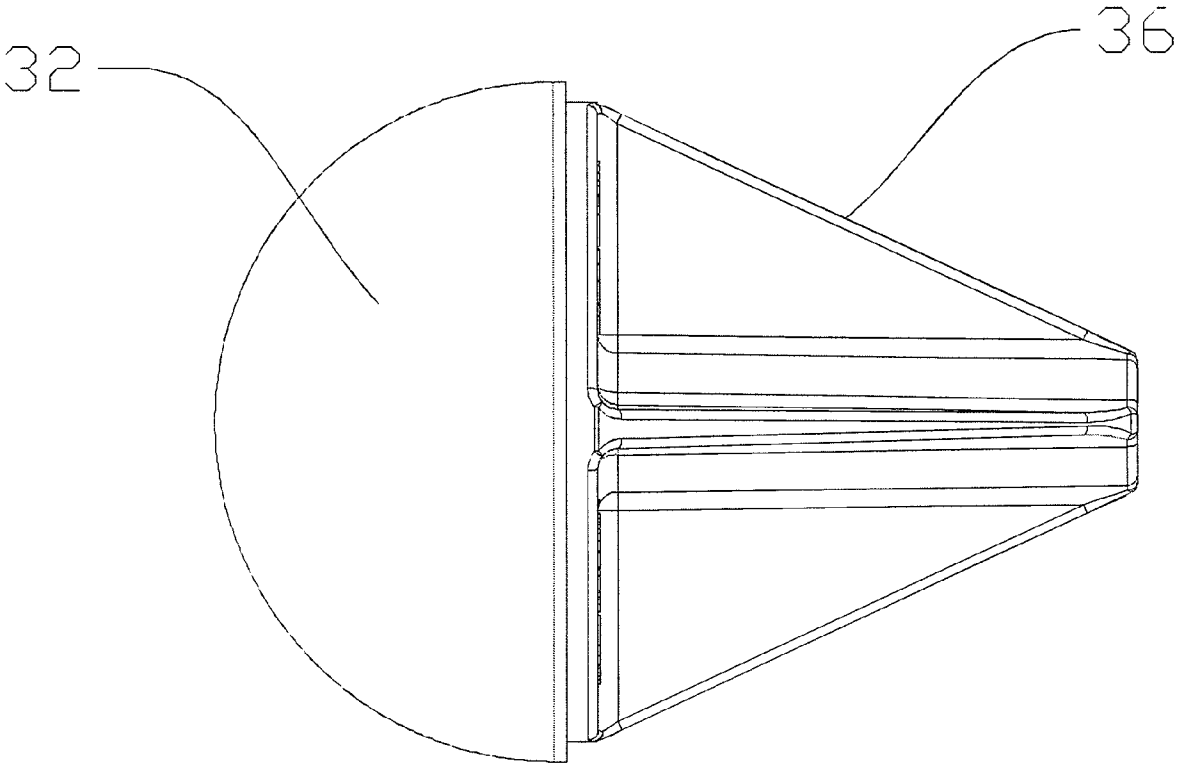
FIG. 6 illustrates a hemispherical foam tip.

The non-lethal arrowhead assembly 18 includes a tip connector 30 and a foam tip 32. As illustrated, the foam tip 32 is connected to the tip connector 30 and has a generally cylindrical shape. In the preferred embodiment, the foam tip 32 is made from a material that is relatively durable, yet soft, so that players playing the sport of "Archery Tag™" are not injured upon impact from the non-lethal arrow 10. In other forms, the foam tip 32 can have a spherical or hemispherical shape, which is illustrated in FIG. 6.

Figure 2:
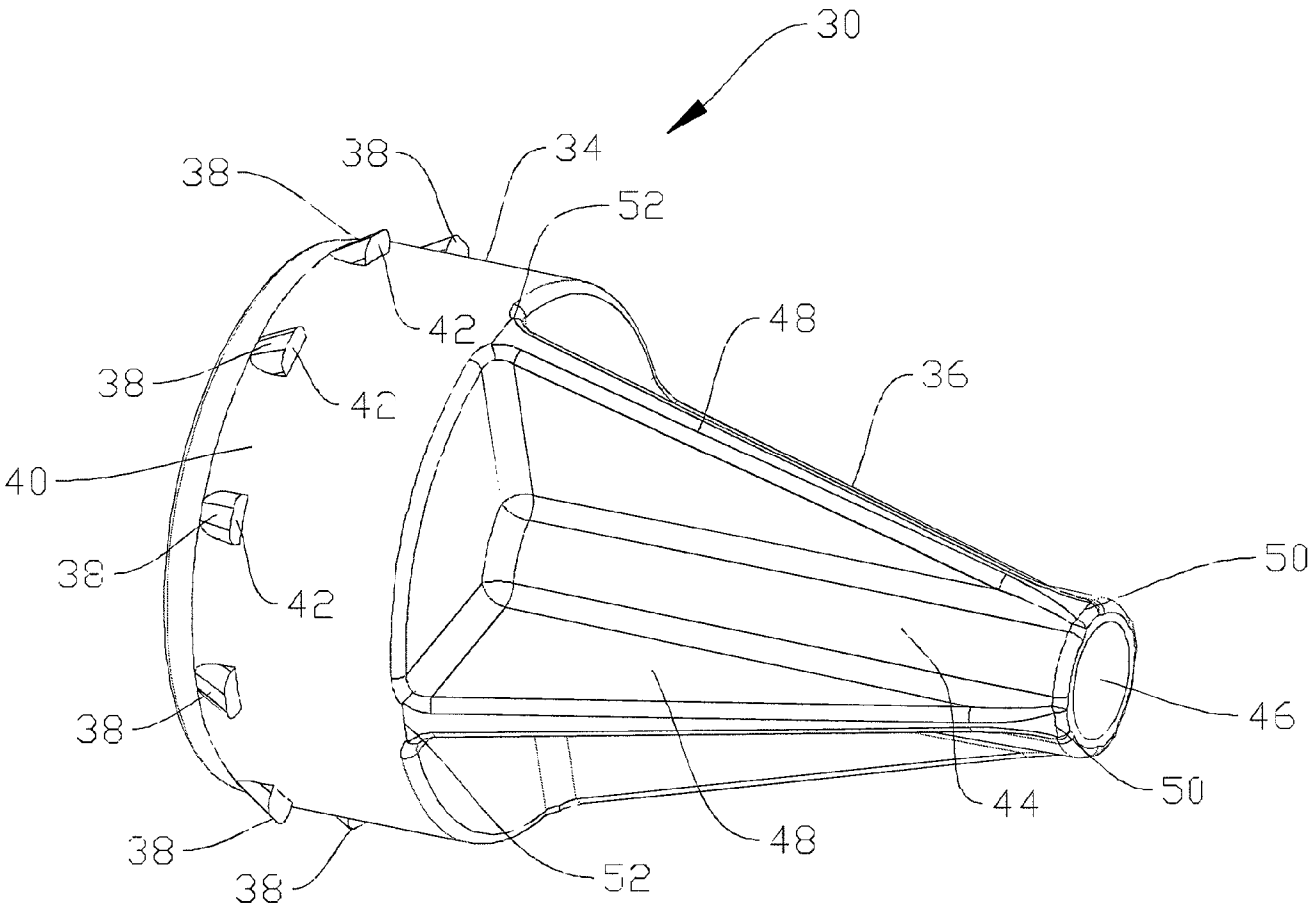
FIG. 2 illustrates a tip connector.

Referring to FIG. 2, a perspective view of an illustrative tip connector 30 is depicted with the foam tip 32 removed. The tip connector 30 includes a foam tip connection end 34 and a shaft connection end 36. The foam tip connection end 34 has a generally cylindrical shape and includes a plurality of securing barbs 38 protruding outwardly from an outer end 40 of the foam tip connection end 34. As illustrated, the barbs 38 are positioned circumferentially about the foam tip connection end 34. In one form, the securing barbs 38 are tapered upwardly toward a generally flat back surface 42. This allows the foam tip 32 to be gripped by the securing ribs 38 thereby preventing the foam tip 32 from sliding off of the foam tip connection end 34. In one form, the foam tip 32 is slid over the foam tip connection end 34 in a friction fit manner so that the foam tip 32 can readily be replaced if it wears out during use or otherwise becomes damaged. In other forms, the foam tip 32 could be secured to the foam tip connection end 34 by glue or some other equivalent securing means.

As further illustrated in FIG. 2, the tip connector 30 also includes the shaft connection end 36. In this form, the shaft connection end 36 includes an elongate cylindrical portion 44. The elongate cylindrical portion 44 defines a hollow tube 46 that is sized and configured to receive the shaft 12 of the non-lethal arrow 10. In one form, the tip connector 30 is configured to be friction fit to the shaft 12 of the non-lethal arrow 10. However, in other forms, the tip connector 30 may be secured to the shaft 12 of the non-lethal arrow 10 using glue or some other suitable securing means. As further illustrated, extending upwardly from the elongate cylindrical portion 44 of the tip connector 30 is a plurality of fins 48. The fins 48 taper upwardly from a rear end 50 of the elongate cylindrical portion 44 to an outside edge 52 of the foam tip connection end 34. In other forms, the shaft connection end 36 is formed having a cone shaped configuration.

Figure 3:
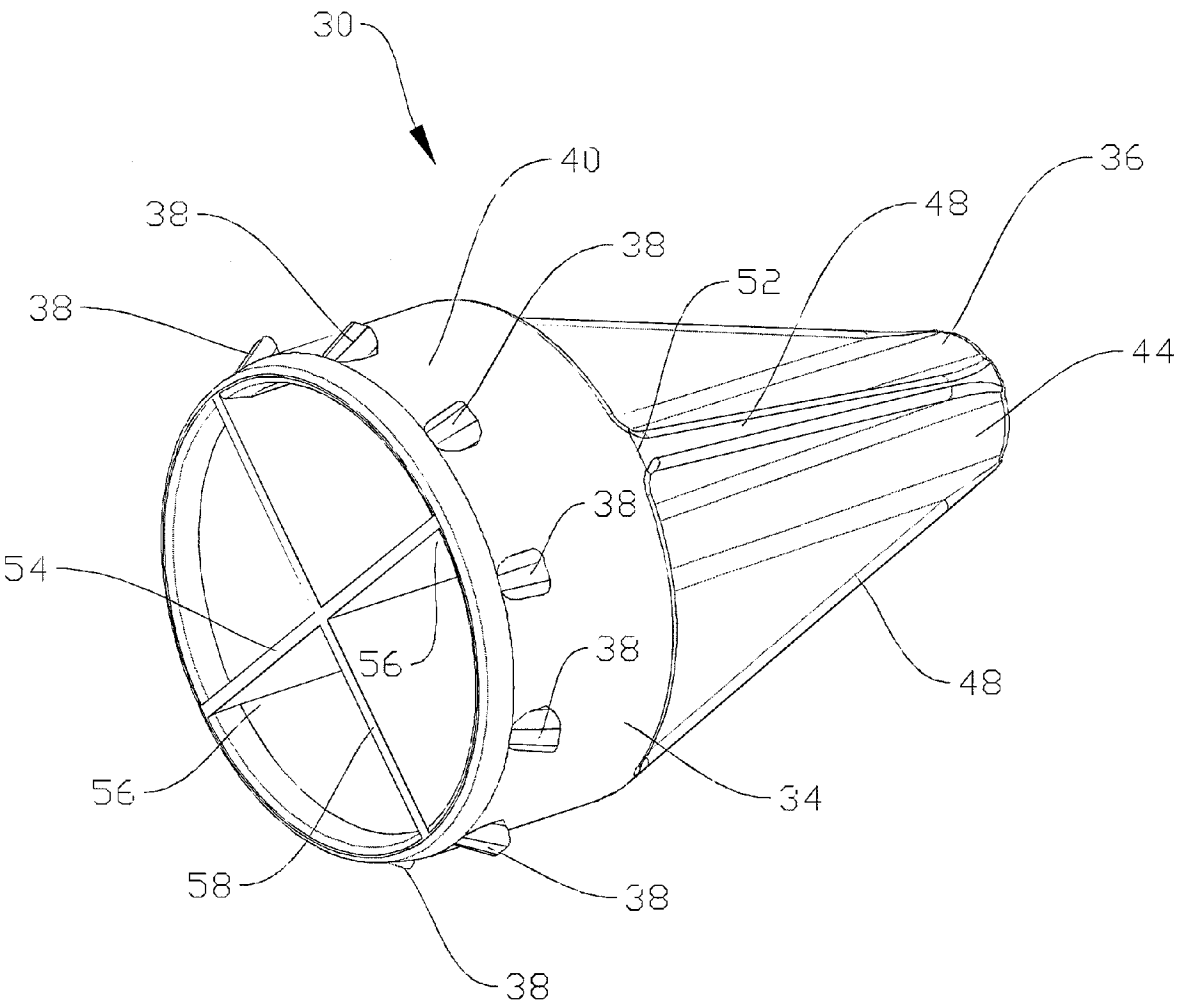
FIG. 3 is another view of the tip connector illustrated in FIG. 2.
Figure 4:
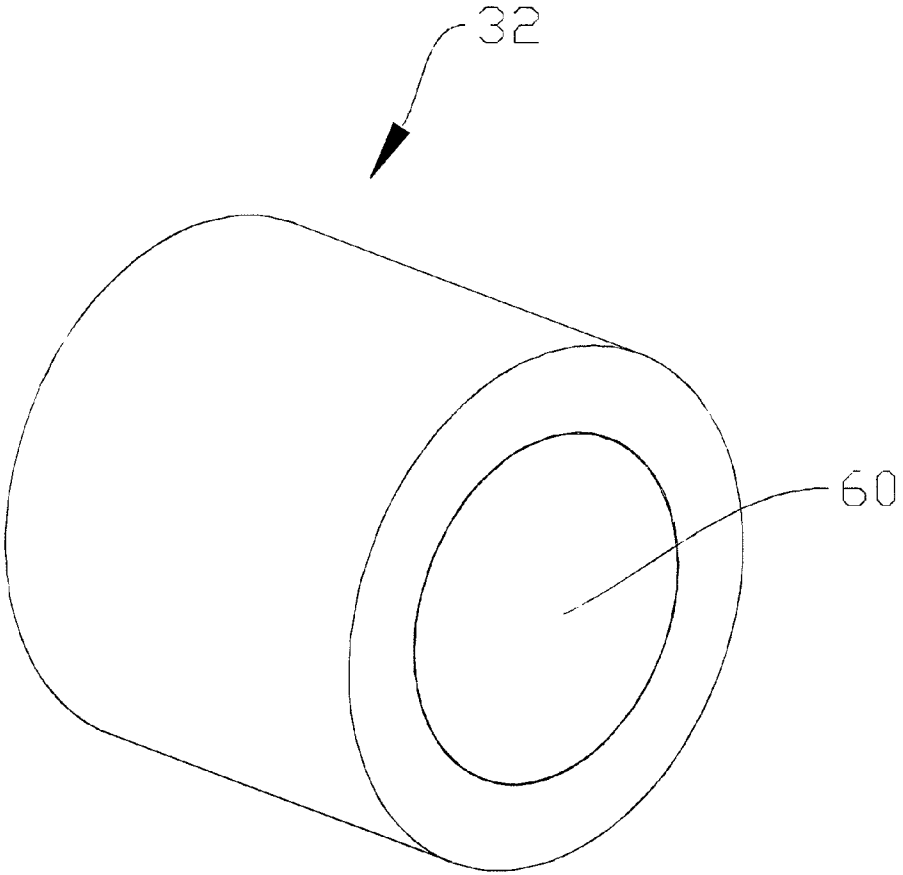
FIG. 4 illustrates a foam tip.

Referring to FIG. 3, in one form the foam tip connection end 34 is generally internally hollow. A horizontal support member 54 extends across opposing sides 56 of the foam tip connector end 34. In addition, a vertical support member 58 extends across opposing sides 56 of the foam tip connector end 34. Referring to FIG. 4, a perspective view of a representative foam tip 32 is illustrated. The foam tip 32 has a generally cylindrical shape and has an aperture 60 on one end of the foam tip 32. The aperture 60 is sized and configured to fit around the foam tip connection end 34 of the tip connector 30. The foam tip 32 is shaped such that no sharp surfaces are present on the outer surface of the foam tip 32.

Figure 5:
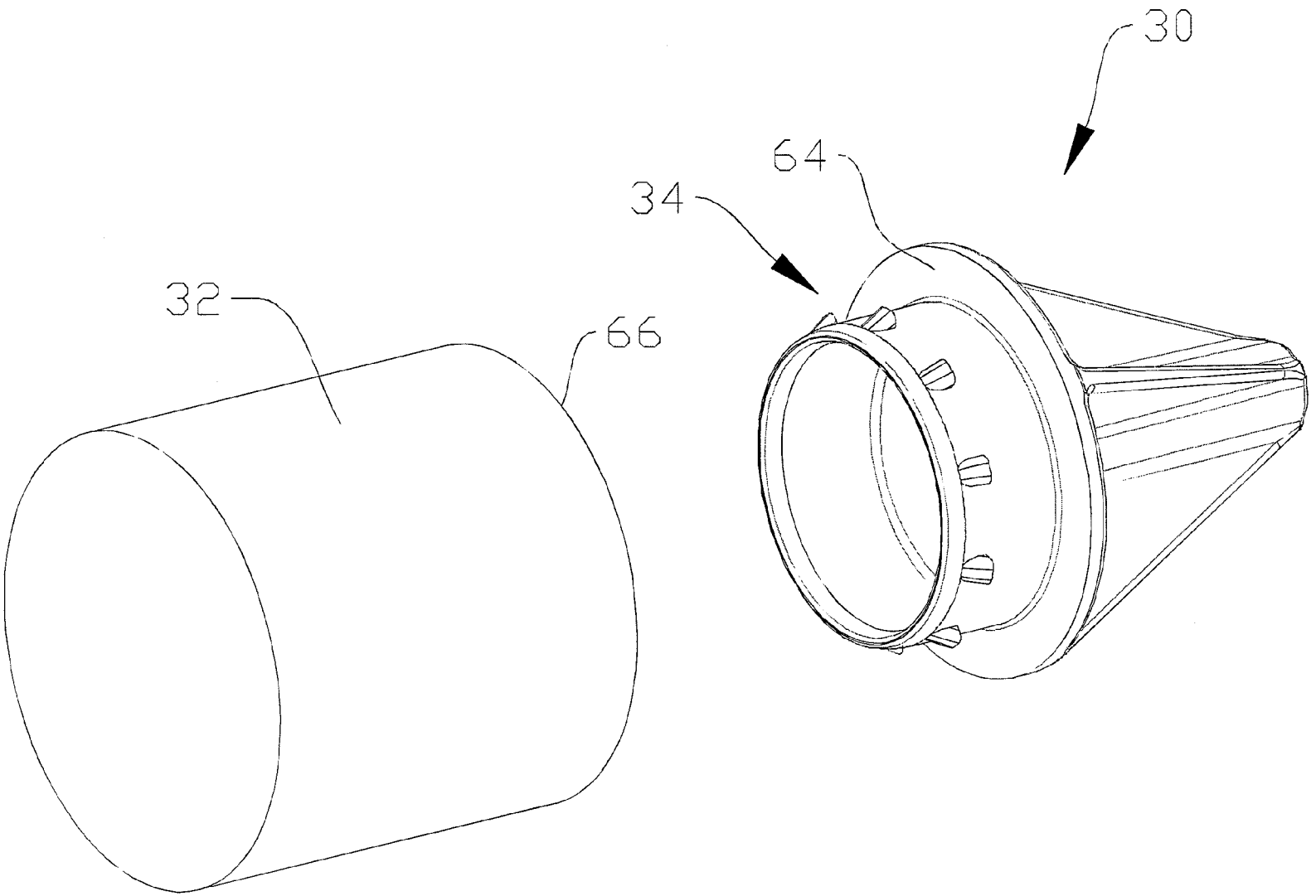
FIG. 5 illustrates another tip connector.

Referring to FIG. 5, another representative form of a tip connector 30 is illustrated. In this form, the foam tip connection end 34 has a smaller diameter than the previous embodiment thereby creating a backstop portion or rim 64. As a result, an end 66 of the foam tip 32 rests against the rim 64 when the foam tip 32 is inserted over the foam tip connection end 34. All other features of the tip connector 30 are the same as previously discussed with the first embodiment.

Figure 7:
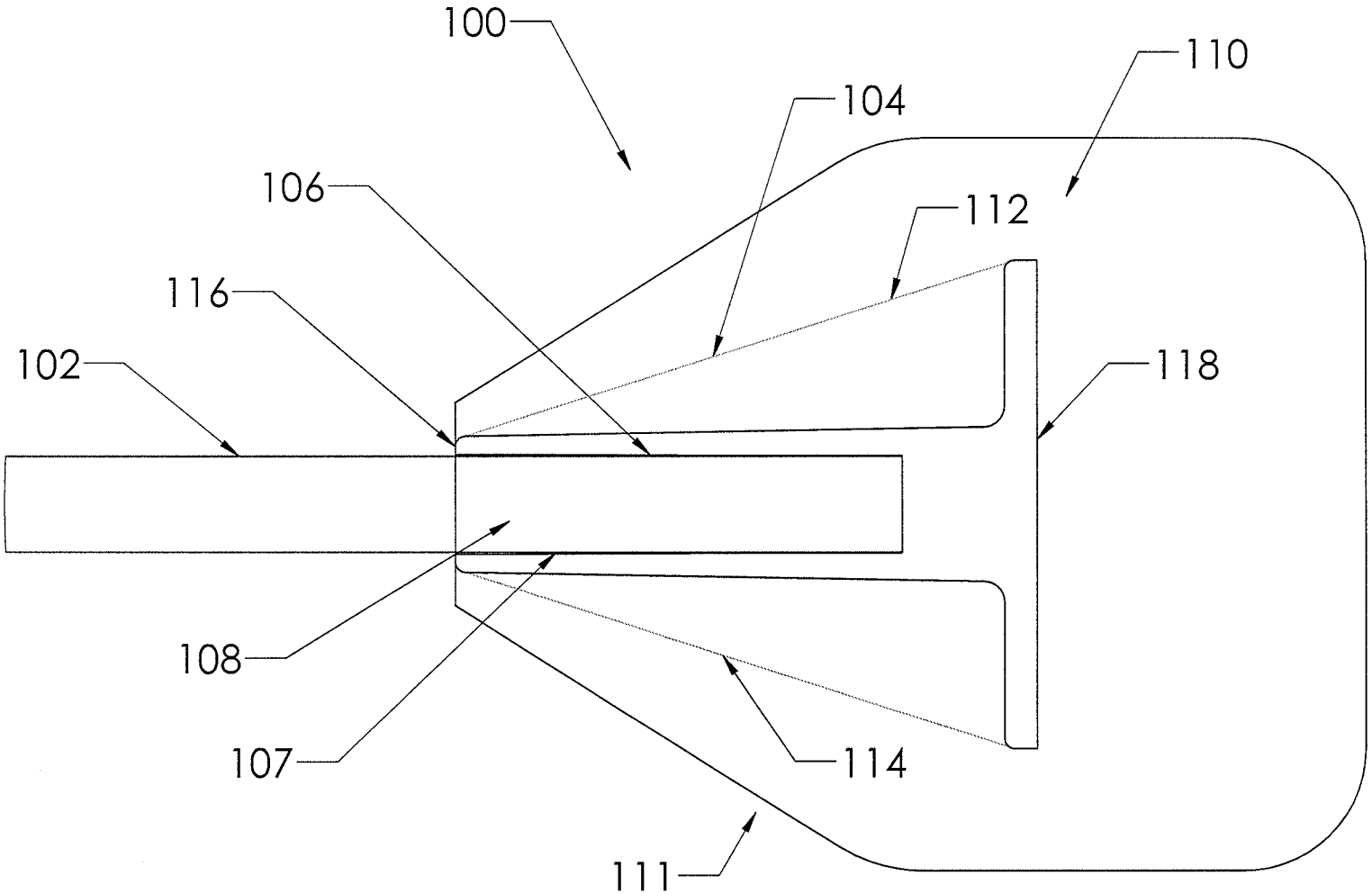
FIG. 7 illustrates a portion of a non-lethal arrow having an overmolded foam tip.

Referring to FIG. 7, a portion of another illustrative non-lethal arrow 100 is illustrated in a cross-section view. The arrow 100 includes a shaft 102 that is connected with a tip connector 104. The tip connector 104 includes a shaft connection end 106 that defines a hollow interior portion or tube 107 that is sized and configured to receive an end 108 of the shaft 102. In one form, the hollow tube 107 is sized such that the end 108 of the shaft 102 is friction fit into the hollow tube 107. In another form, the end 108 of the shaft 102 is secured in the hollow tube 107 using an adhesive.

In the illustrated form of the non-lethal arrow 100, a foam tip 110 surrounds and is connected with the entire tip connector 104. In other forms, the foam tip 110 surrounds and is secured to at least a portion of the tip connector 104. As such, the tip connector 104 includes a foam tip connection end 112 to which the foam tip 110 surrounds and is connected with the tip connector 104. In one form, the foam tip 110 is overmolded to surround the entire tip connector 104 or a portion of the tip connector 104. Overmolding is a process that combines two different materials to produce a unique part. In one form, the tip connector 104 is formed using a rigid material such as plastic for example. The foam tip 110 is then molded over the tip connector 104 to create a unitary foam tip assembly 111. The foam tip 110 is formed using a soft material such as a polymer based foam so as not to injure someone who is hit by the arrow 100.

The tip connector 104 includes a plurality of fins 114 that extend upwardly from a rear end 116 of the tip connector 104 to a front end 118 of the tip connector 104. The area between the fins 114 is open so that the foam of the foam tip fills the gaps between the fins 114 thereby securing the foam tip 110 to the tip connector 104. In one form, the front end 118 of the tip connector 104 has a generally circular shape, but other shapes may be used as well. In the form in which the tip connector 104 is friction fit on the shaft 102 of the non-lethal arrow 100, the unitary foam tip assembly 111 is designed so that it can be readily replaced if needed.

Figure 8:
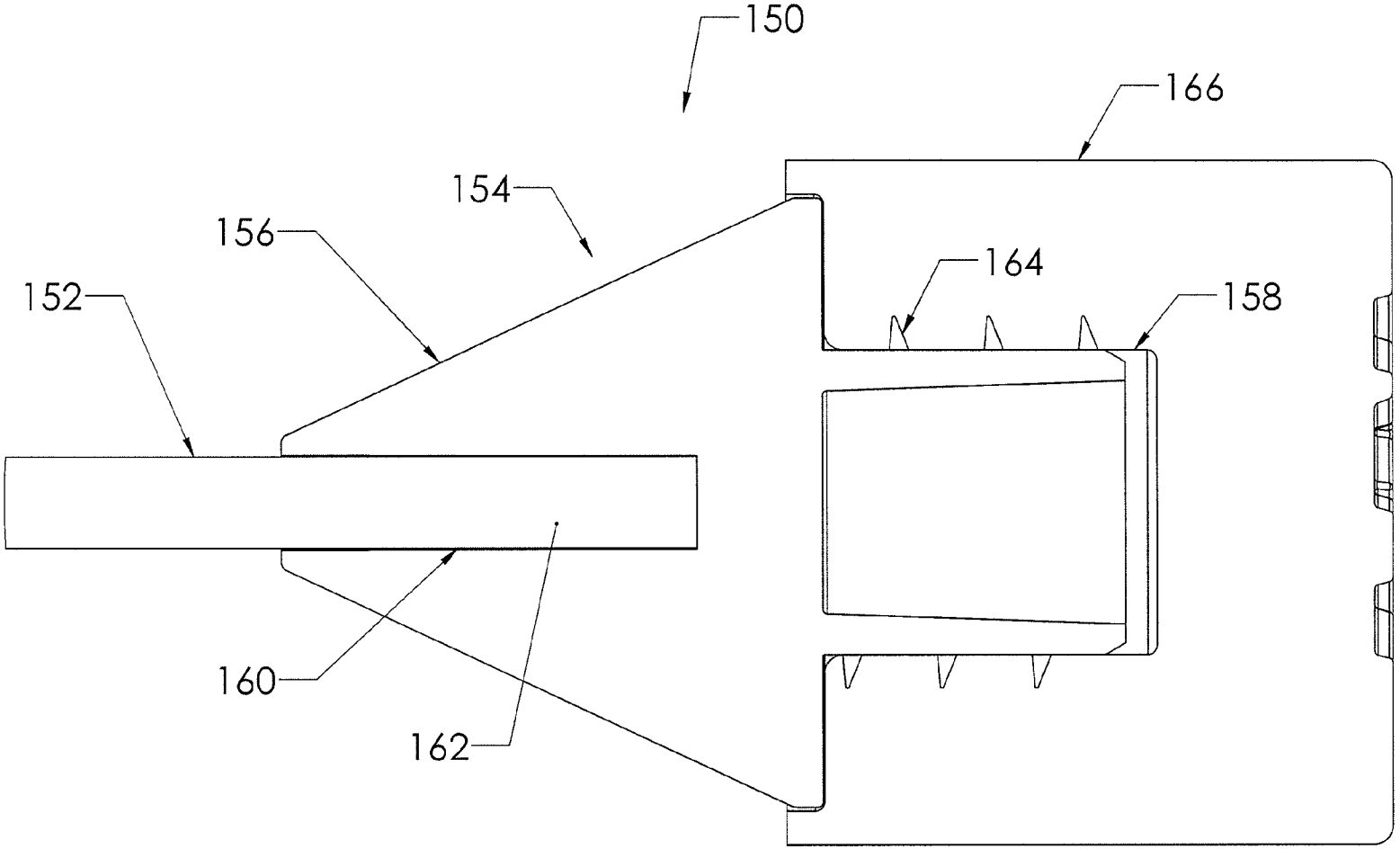
FIG. 8 illustrates a portion of a non-lethal arrow having a foam tip threaded to a tip connector.

Referring to FIG. 8, another representative form of a non-lethal arrow 600 is illustrated in a cross-section view. The arrow 600 includes a shaft 602 that is connected with a tip connector 604. The tip connector 604 includes a shaft connection end 606 and a foam tip connection end 608. The shaft connection end 606 is connected with the shaft 602. The shaft connection end 606 defines a hollow interior portion sized a configured to receive an end 612 of the shaft 602. The foam tip connection end 608 includes a threaded portion 614. A foam tip 616 is secured to the thread portion 614 of the foam tip connection end 608. Threading the foam tip 616 to the foam tip connection end 608 allows the foam tip 616 to readily be replaced after a period of use. In one form, the shaft connection end 606 has a generally cone shape. In one form, the foam tip connection end 608 has a generally circular shape.

Although embodiments of the invention have been described using specific terms, such description is for illustrative purposes only, and it is to be understood that changes and variations obvious to the skilled artisan are to be considered within the scope of the claims that follow and their equivalents.

What is claimed is:

1. A non-lethal arrow, comprising:

a shaft; and a foam tip assembly connected with an end of said shaft, wherein said foam tip assembly comprises a tip connector having a foam tip overmolded to at least a portion of the tip connector such that said foam tip is securely attached to said tip connector.

2. The non-lethal arrow of claim 1, wherein said tip connector includes an elongate cylindrical portion defining a hollow interior, wherein said shaft is positioned in said hollow interior of said elongate cylindrical portion.

3. The non-lethal arrow of claim 2, wherein said tip connector includes a plurality of fins that extend upwardly from said elongate cylindrical portion.

4. The non-lethal arrow of claim 3, wherein said fins taper upwardly from a rear end of said elongate cylindrical portion to a front end of said tip connector, wherein said foam tip is overmolded to fill areas defined between said fins and to surround said front end to thereby secure said foam tip to said tip connector.

5. The non-lethal arrow of claim 4, wherein said front end has a generally circular shape.

6. The non-lethal arrow of claim 1, wherein said foam tip is overmolded over the entire tip connector.

7. The non-lethal arrow of claim 1, wherein said foam tip is overmolded around at least a portion of said tip connector.

8. The non-lethal arrow of claim 1, wherein said foam tip is overmolded to completely surround said tip connector.

9. The non-lethal arrow of claim 1, wherein said hollow interior portion is positioned within an elongate cylindrical portion of said tip connector, wherein said shaft connection end includes a plurality of fins that taper upwardly from a rear end of said elongate cylindrical portion to a front end of said tip connector.

10. A non-lethal arrow, comprising:

a shaft;

a tip connector including a shaft connection end, wherein said shaft connection end is connected with said shaft, wherein said shaft connection end defines a hollow interior portion sized and configured to receive an end of said shaft; and a foam tip surrounding at least a portion of said tip connector.

11. A non-lethal arrow, comprising:

a shaft;

a tip connector including a shaft connection end and a foam tip connection end, wherein said shaft connection end is connected with said shaft, wherein said shaft connection end defines a hollow interior portion sized and configured to receive an end of said shaft, wherein said foam tip connection end includes a threaded portion; and a foam tip secured to said threaded portion of said foam tip connection end.

12. The non-lethal arrow of claim 11, wherein said shaft connection end has a generally cone shape.

13. The non-lethal arrow of claim 12, wherein said foam tip connection end has a generally circular shape.

* * * * *